US006536194B2

(12) United States Patent
Minardi

(10) Patent No.: US 6,536,194 B2
(45) Date of Patent: Mar. 25, 2003

(54) METHOD AND APPARATUS FOR FEEDING DVD OR CD BOXES, EMPTY AND CLOSED, TO MEANS FOR OPENING, CUSTOMIZING, FILING AND CLOSING SAID BOXES

(75) Inventor: Tarcisio Minardi, Faenza (IT)

(73) Assignee: Miri S.r.l., Faenza (IT)

( * ) Notice: Subject to any disclaimer, the term of this patent is extended or adjusted under 35 U.S.C. 154(b) by 134 days.

(21) Appl. No.: 09/784,128

(22) Filed: Feb. 16, 2001

(65) Prior Publication Data

US 2001/0015055 A1 Aug. 23, 2001

(30) Foreign Application Priority Data

Feb. 18, 2000 (IT) ..... BO2000A0071

(51) Int. Cl.[7] ..... B65B 43/26; B65B 5/10; B65B 39/12

(52) U.S. Cl. ..... 53/564; 53/254

(58) Field of Search ..... 53/468, 476, 484, 53/564, 254, 238, 474, 382.1, 381.1, 492, 443, 284.5

(56) References Cited

U.S. PATENT DOCUMENTS 5,664,405 A * 9/1997 Perego ..... 53/284.5
6,035,605 A * 3/2000 Perego ..... 53/117
6,048,158 A * 4/2000 Zaniboni ..... 414/226.02
6,233,909 B1 * 5/2001 Onishi ..... 53/238
6,324,816 B1 * 12/2001 Yamamoto ..... 53/254
6,374,574 B1 * 4/2002 Onishi ..... 53/238
6,397,564 B1 * 6/2002 Yamamoto ..... 53/157
6,418,703 B1 * 7/2002 Yamamoto ..... 53/564

* cited by examiner

*Primary Examiner*—Rinaldi I. Rada
*Assistant Examiner*—Paul R Durand
(74) *Attorney, Agent, or Firm*—Larson & Taylor PLC

(57) ABSTRACT

A cyclical extraction of an empty and closed box from a feeding magazine is performed by an extractor and an opposite contrast device which transfer the box into an opening station. The contrast device rotates of 90°, opening the box and entering it. While the contrast device goes back, the extractor places the box open on underlying double-slope inclined planes, on which the box is finally placed by arc-shaped and oscillating levers. While the contrast device goes back, the open box is transferred to an adjacent parking station which includes an upper contrast device to maintain the box on the support guides. A finger completely opens downwards an external pocket of the transferred box, and a known device introduces into the pocket a customizing insert sheet. The open box then leaves the parking station and reaches is transferred to filling and closing stages.

15 Claims, 11 Drawing Sheets

METHOD AND APPARATUS FOR FEEDING DVD OR CD BOXES, EMPTY AND CLOSED, TO MEANS FOR OPENING, CUSTOMIZING, FILING AND CLOSING SAID BOXES

DESCRIPTION

The present invention relates to a method and apparatus to automatize a plurality of operations which are usually carried out manually and which consist in opening originally empty DVD or CD boxes, in customizing them with an external insert sheet containing information about the disk, then in filling them with the disk and possibly with a leaflet and eventually in closing them.

The method according to the invention is characterized by the following operating stages:

- Extraction of an empty and closed box from a pile of boxes and transfer of said box to an opening station;
- Opening of said box with a rotation over 180° of the two portions it consists of, so that said portions are orientated with their inside upwards and are placed so as to form an upside-down "V";
- Transfer of said open box to an adjacent parking station where said box is kept by its long and free sides of both portions it consists of, said portions maintaining their original location as an upside-down "V", so that the external cover made of transparent plastic is free and comes to be arranged downwards by gravity, thus opening the pocket formed within said cover;
- Lozenge-shaped opening of said external pocket of said box placed in the parking station and introduction into said pocket of a customized insert sheet prepared with an undulated profile;
- Letting free said externally customized box in the parking station, so that said box falls onto means transferring it open and horizontally towards following filling and closing stages.

Further characteristics and advantages of the present invention will be evident from the following description of a preferred embodiment, shown as non-limiting example in the Figures of the attached sheets of drawings, in which.

Figure 1:
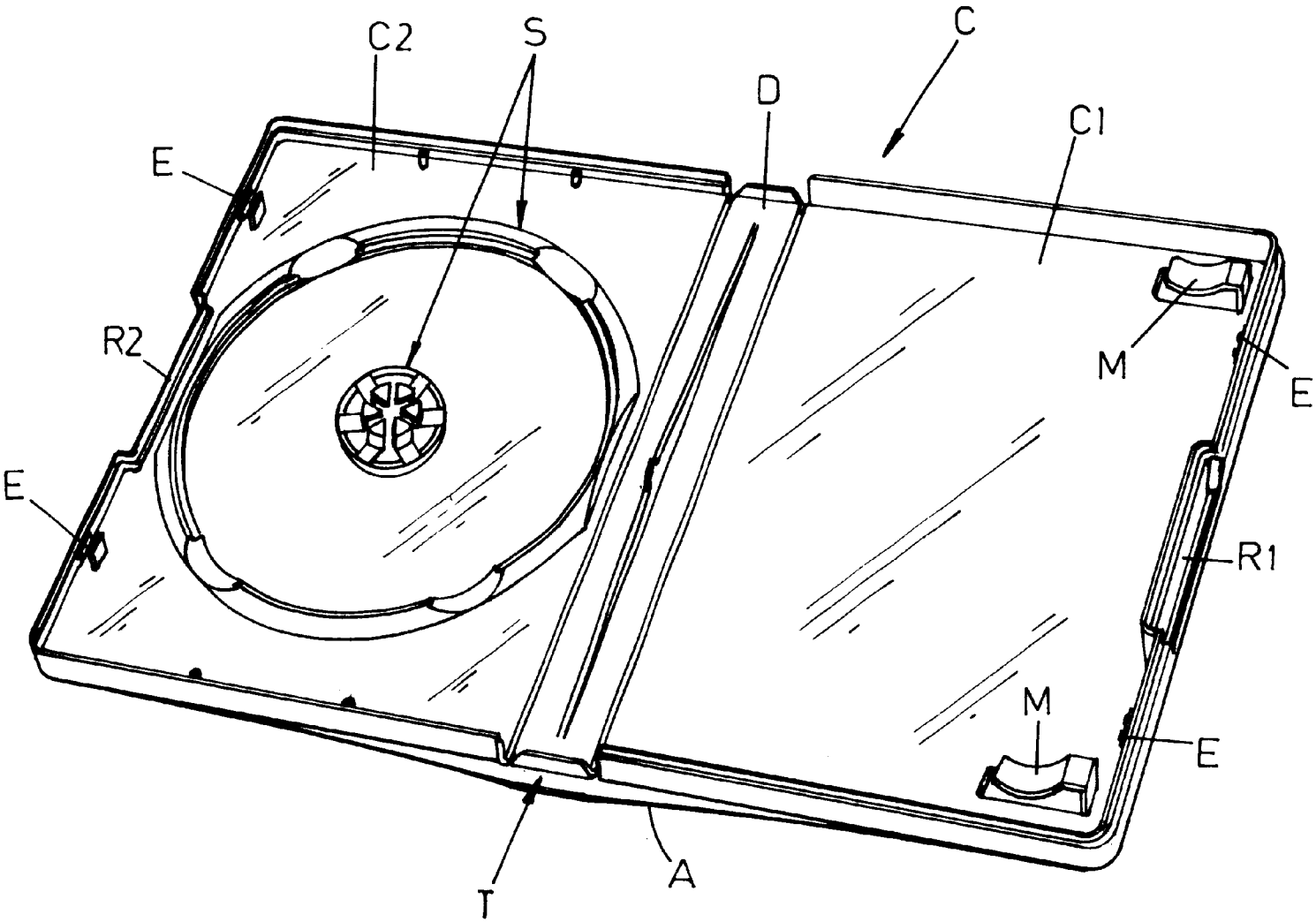
FIG. 1 is a perspective view of a box in an open condition.

The box C shown in FIG. 1 generally contains a DVD disk and it consists of two portions C1 and C2 interconnected like a book by means of a back D, said portion C2 showing on its internal face a projecting seat S to support the disk. Portion C1 shows on its internal face and on its external long side flexible tabs M to which a leaflet can be hooked, said leaflet integrating the contents of the disk introduced into said portion C2. On the external long sides, portions C1 and C2 of said box show identical central recesses R1 and R2 overlapping when the box is closed and forming a recess R (see below) having a rectangular shape, into which the user can introduce his fingers while opening said box. On said external long sides, portions C1 and C2 of said carry complementary appendices E reciprocally cooperating snapwise to close said box.

To the long sides of the portions C1 and C2 of said box there has been welded a cover A made of transparent plastic, which covers externally said box and creates an external pocket T into which an insert sheet can be introduced, said insert sheet appearing through said cover and customizing said box and/or the contents of the disk contained in said box.

Figure 2:
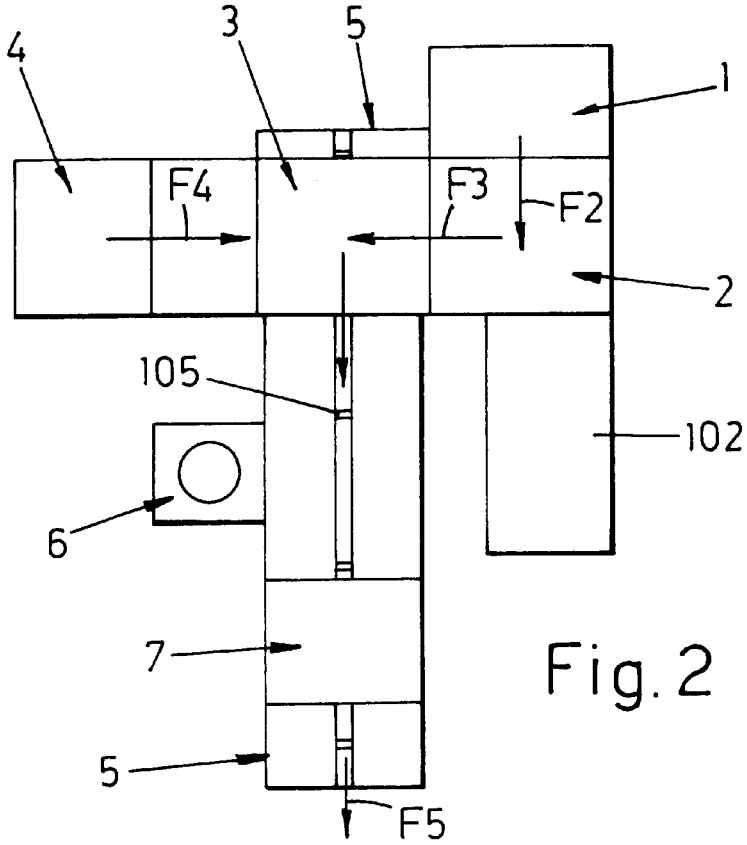
FIG. 2 is a block diagram of the apparatus according to the invention.

The apparatus here described, as schematically shown in FIG. 2, comprises a magazine 1 in which the empty and closed boxes C are placed horizontally and then piled one onto the other, with their portion C2 upwards and the recess R in the direction F2 of the cyclical introduction of a box into a station 2 adjacent to the magazine, in which said box is opened and its portions C1 and C2 are inclined downwards to form an upside-down "V". In the station 2 the portion C2 of the opened box is near the magazine 1. The numeral 102 indicates the space occupied on one side by the contrast means (see below) cooperating to the cyclical transfer of a box from magazine 1 to station 2 and then providing for the opening of said box in station 2. A parking station 3 is provided laterally with respect to station 2, the box opened in station 2 being transferred, as indicated with F3, into said parking station, where the external pocket T of said box is opened and a customizing insert sheet taken from a station 4 is introduced into said pocket. The parking station 3 is placed on the central line of an underlying rectilinear conveying channel 5, in which said station unloads the customized box, open and placed horizontally. The conveying channel 5 is provided with pushing teeth 105 which, by means of an intermitting movement, move said box to a station 6 providing for the introduction of a disk into the seat S and for the possible introduction of a leaflet under the tabs M of portion C1 of said box, and to a final closing station 7. The customized box, filled and closed, finally gets out from the end portion of the conveying channel 5, as indicated by arrow F5.

The apparatus here described substantially comprises the above-mentioned portions 1, 2 and 3, which should be regarded as protected also independently from the other components of the machine disclosed with reference to FIG. 2.

Figure 3:
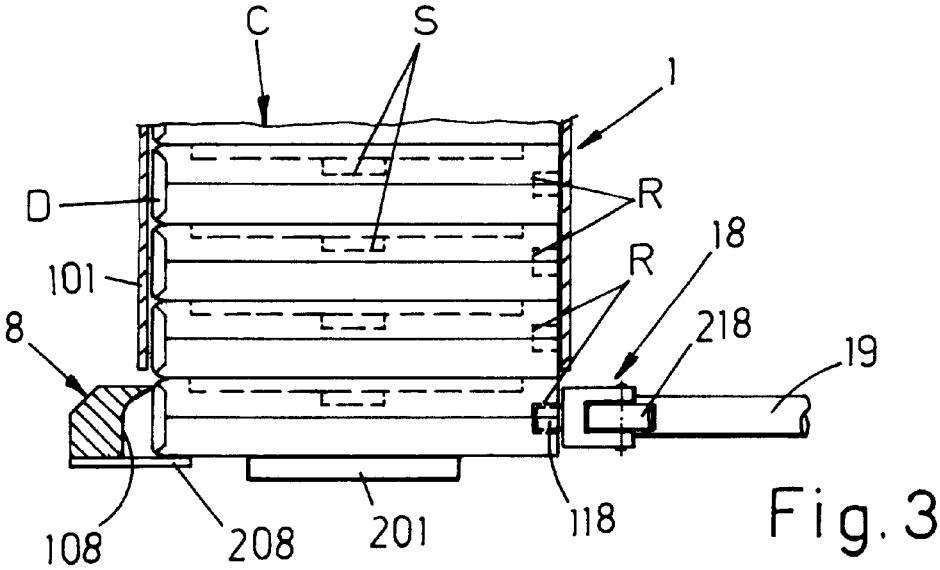
FIGS. 3, 4 and 5 are lateral schematic views with sectioned parts of the magazine containing the empty boxes and of the extraction and contrast means transferring cyclically the bottom box from said magazine to the opening station.
Figure 6:
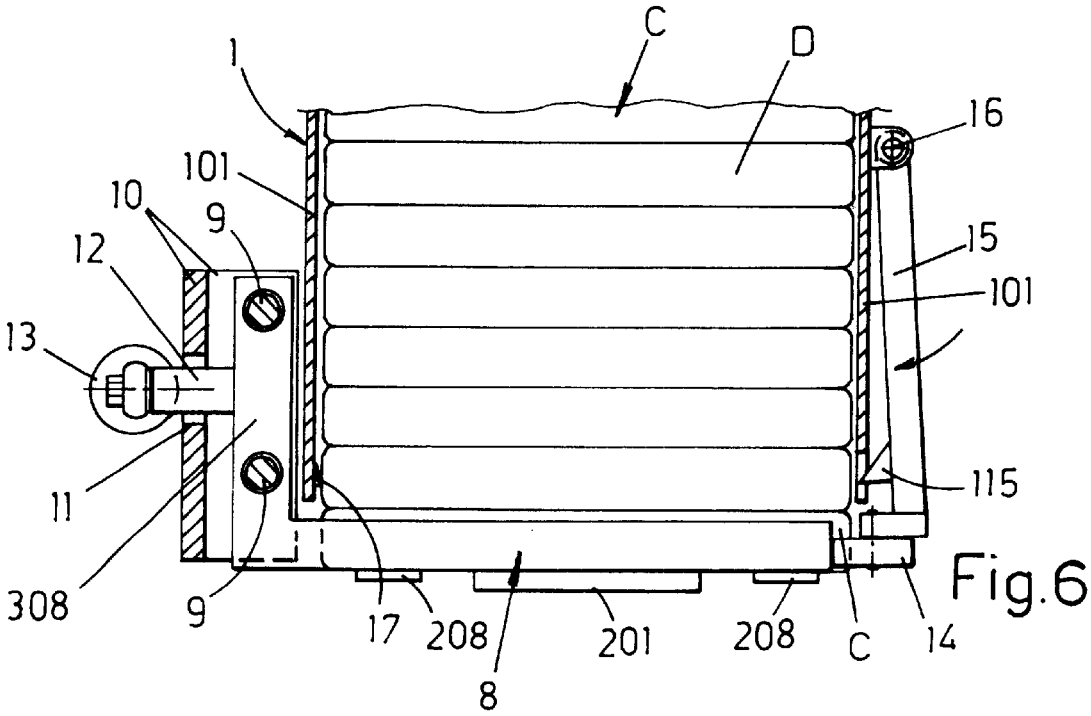
FIG. 6 shows the box magazine in a front external view, partly sectioned and with the extractor in the position of cycle start.

From FIGS. 3 and 6 it can be seen that the magazine 1 comprises a parallelepiped-shaped vertical structure 101 in which the empty and closed boxes C are placed horizontally and are piled one onto the other in the right amount and with the aforesaid orientation. The structure 101 is laterally open in its lower portion to enable the exit of the bottom box resting onto a central fixed plane 201. On the back D of the bottom box, parallel to this and outside the magazine 1, the extraction bar or extractor 8 is located in its rest position, said bar having the same or a slightly lower height with respect to the box thickness, having the front 108 placed towards the magazine and with a hollow profile, and whose bottom wall is at such a level to pass without interference on the plane 201, being on said lower wall fixed a pair of springy tabs 208 protruding for a given projecting portion from the front 108 of the extractor 8 and which are laterally placed with respect to the plane 201, so as not to interfere with the latter. An end of the extractor 8 is integral with a carriage 308 sliding on a pair of horizontal guides 9, orthogonal with respect to said extractor and supported by a portion 10 of the fixed frame of said apparatus, said portion 10 being equipped with a slot 11 parallel to the guides 9, said slot crossed by an extension 12 integral with the carriage 308 and connected to the stem of a fluid pressure cylinder 13, which is also parallel to the guides 9 and anchored with its body to the outside of said frame portion 10.

When the extractor 8 is in the position of cycle start as shown in FIG. 3, its farthest end from the carriage 308 cooperates with the vertical-axis roller 14 mounted on the foot of a lever 15 placed vertically on a side of the magazine 1, connected in 16 to said side and stressed by elastic means for the cooperation with the extractor. In this situation an extension 115 of the lever 15, which passes through a lateral opening of the magazine 1, is in a position far from the side of the second-last bottom box of said magazine. In opposition to the moving extension 115, on the other side of the magazine 1 it is preferably provided for a similar extension 17 which can be fixed or associated with a lever analogous to lever 15, so that when the extractor makes its active work stroke and leaves the roller 14, the second-last bottom box of the magazine is laterally pinched between the extensions 115 and 17 and remains in said lifted position, with all the boxes lying over it, so that the extractor can make its forward and return stroke without interfering with the boxes lying over the extracted box. Only after the extractor 8 has passed through the bottom of the magazine 1 in its return stroke and has cooperated with the roller 14, thus causing the reciprocal removal of the extensions 115–17, the pile of boxes of said magazine rests again onto the fixed plane 201.

Figure 7:
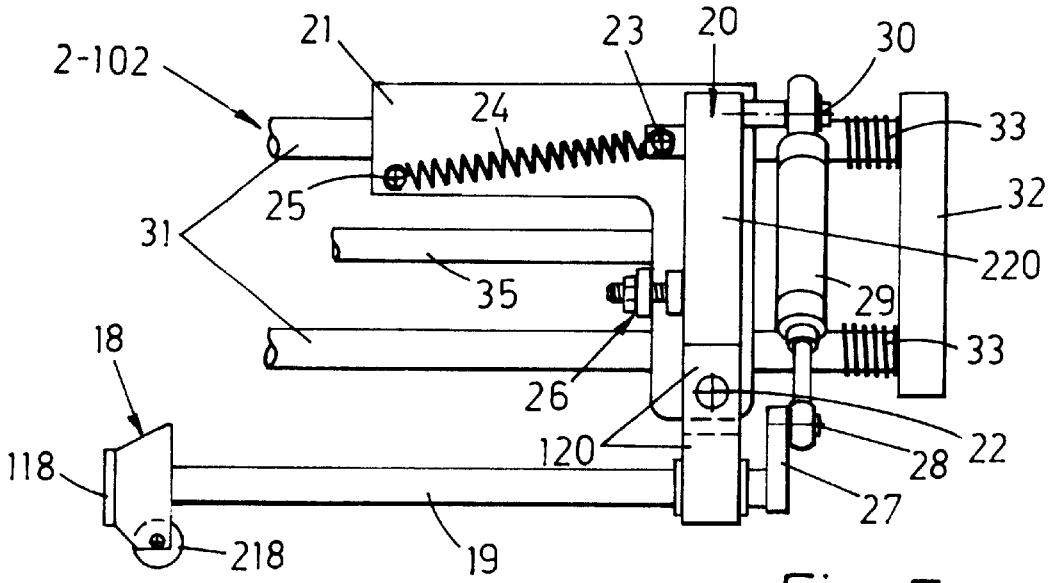
FIGS. 7 and 8 are a view in lateral elevation and a plan view from above, respectively, of the contrast means with its support carriage.
Figure 8:
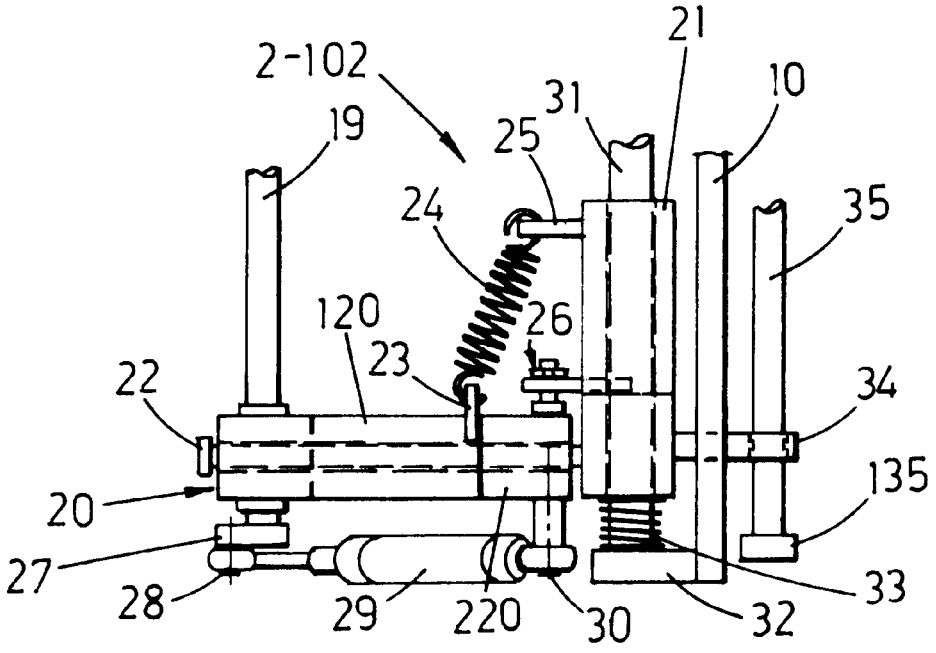

From FIGS. 3, 7 and 8 it can be observed that the bottom box C of the magazine 1, contacted on its back by the extractor 8, has the recess R opposed to said back, engaged by the front protuberance 118 of the smaller base of a flat and substantially trapezoidal contrast means 18, placed on the horizontal plane, provided in an angular area of the larger base with an idle roller 218, and is integral with said larger base with a stem 19 parallel to guides 9 of the extractor. The stem 19 is rotatably supported on the end opposed to the one carrying the contrast means 18 by the end of the horizontal portion 120 of a "L"-shaped lever 20, placed transversally to said stem and laterally to a carriage 21 to which said lever portion 120 is pivoted with an orthogonal axis 22 placed above said stem 19. The vertical portion 220 of the lever 20 is connected in 23 to a traction spring 24 anchored in 25 to the carriage 21 and maintaining said lever portion 220 normally abutted against a register 26 integral with said carriage 21, so that the stem 19 of the contrast means 18 can be horizontal or can oscillate upwards if required (see below). The stem 19 protrudes from the portion 120 of the lever 20 with a short portion to which is fixed in a square position an arm 27 connected in 28 to the stem of a small fluid pressure cylinder 29, connected with its body in 30 to the top of the portion 220 of said lever 20. Because of the cylinder 29, the contrast means can move from the horizontal position at cycle start to a vertical or side position in which it is rotated of 90° and placed with the roller 218 downwards (see below). The carriage 21 slides on horizontal guides 31 supported by portions 32 of the fixed frame of the apparatus, on said guides being provided heical springs 33 loading when said carriage reaches the stroke end at the greatest distance from the magazine 1. From FIG. 8 it is evident that the carriage 21 is laterally provided with an extension 34 which passes through a horizontal slot of the fixed portion 10 of the apparatus frame and through which the horizontal stem 35 slidingly passes with the head 135 of a fluid pressure cylinder, not shown, said cylinder being anchored with its body to the outside of said frame portion 10 and opposed to the cylinder 13 operating the extractor 8 of FIG. 6. When the stem 35 is operated in back motion, its head 135 abuts against the extension 34 and moves the carriage 21 of the contrast means 18 in the position of cycle start shown in FIG. 3, with the protuberance 118 of said contrast means engaging the recess R of the bottom box of the magazine 1. After this stage the stem 35 goes back to the position of maximum extension, there being provided that the contrast means 18 follow the bottom box extracted from the magazine 1 by the extractor 8 and there being provided that the carriage 21 of the contrast means slides on its guides 31 with a right friction.

Figure 4:
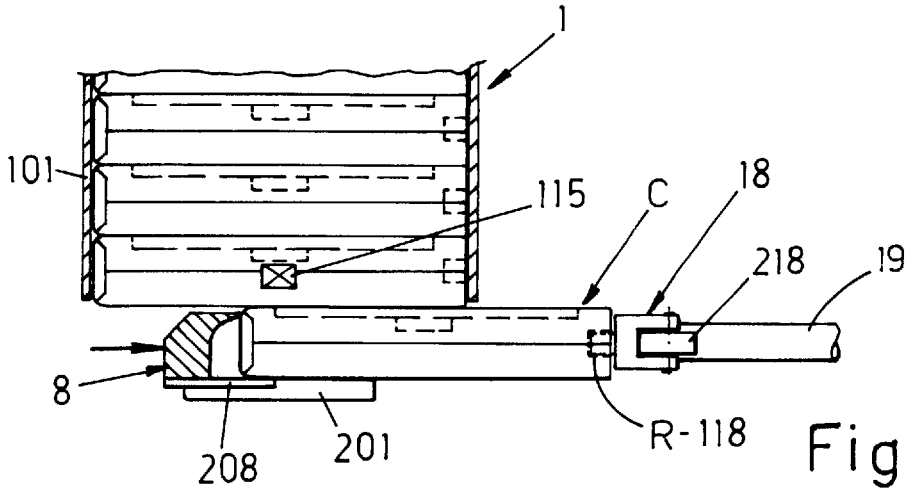
Figure 5:
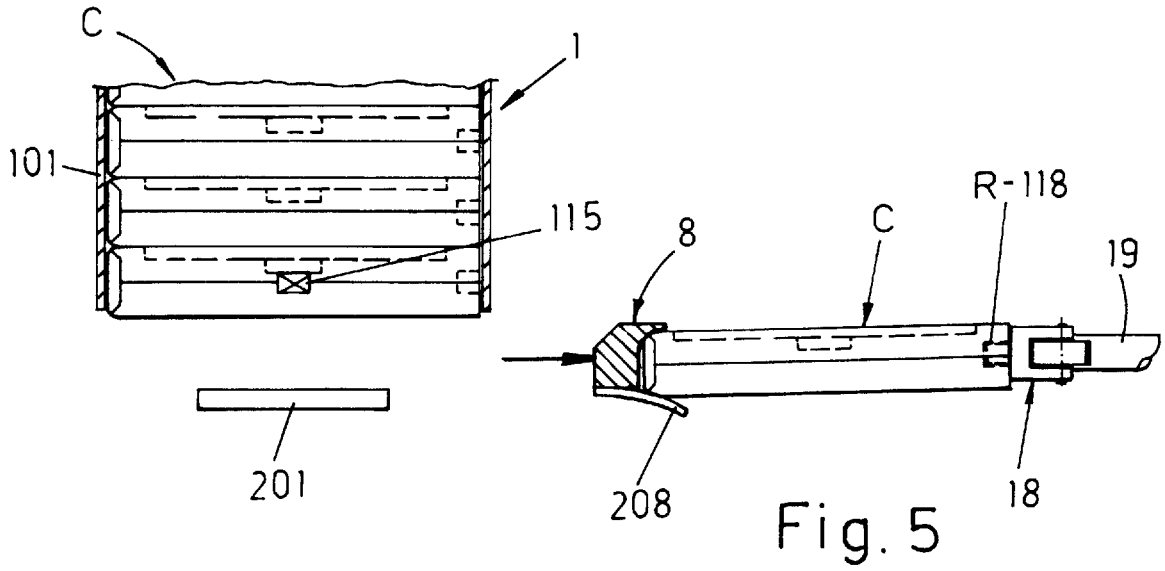

From the sequence of FIGS. 3, 4 and 5 it is evident that the bottom box C extracted from the magazine 1, as soon as it leaves the bottom wall 201, is firmly withdrawn on the recess R by the contrast means 18 and on the back D by the extractor 8. As a consequence of the reaction exerted onto the box by the friction contrast means 18, the back D of said extracted box engages the receding front 108 of the extractor 8, also as a consequence of the bending downwards of the lower tabs 208.

Figure 9:
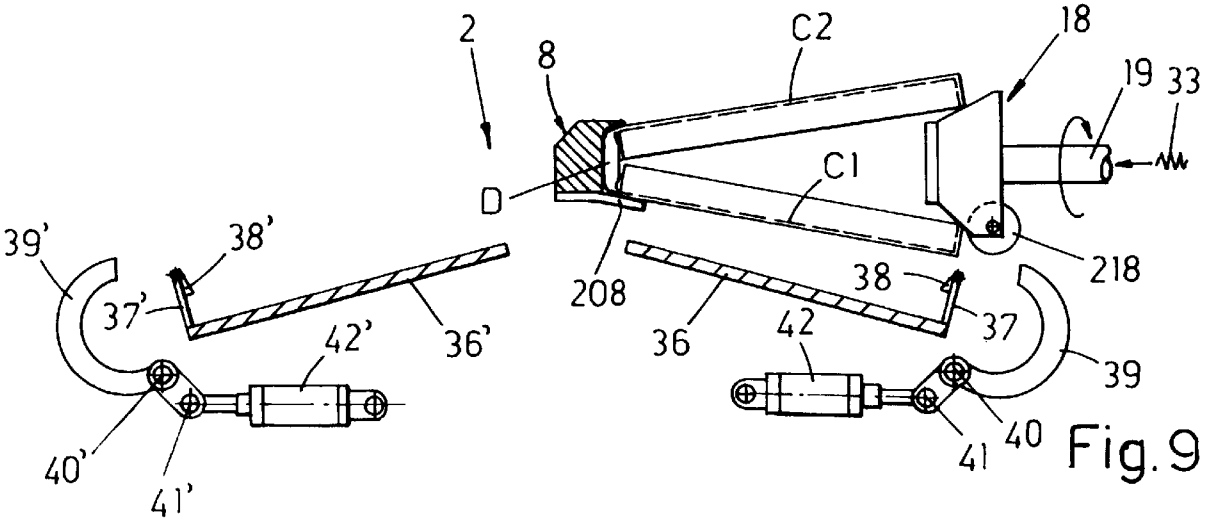
FIGS. 9, 10, 11 and 12 are views in lateral elevation with sectioned parts of the box-opening station, seen in successive stages of its work cycle.

The guides 31 of the carriage 21 of the contrast means 18 occupy part 102 of the block diagram of FIG. 2. When the box C reaches the opening station 2 of FIG. 2, the carriage 21 of the contrast means 18 has reached the return stroke end and has loaded the springs 33. In due time the contrast means 18 is rotated of 90° as in FIG. 9, thus causing the opening of the box, and as a consequence of the action of said springs 33 said contrast means enters between portions C1 and C2 of the open box which is still kept on the back D by the extractor 8 which stops in due time. Under the action of the roller 218 of the contrast means 18, which is now actively moved towards the magazine 1, the lower portion C1 of the box rotates downwards and with its long side gets into contact with the lower portion of one of the inclined double-slope planes 36 of the opening station 2, resting against the stopping edge 37 and passing over a springy tooth 38 which locks said portion C1 of the box. In due time during the return stroke of the contrast means 18, arc-shaped levers 39 also intervene, said levers being fitted onto a shaft 40 which is rotated upon actuation by means of an end lever 41 and a fluid pressure cylinder 42, so that said arc-shaped levers emerge from the low side of the plane 36 to push and withdraw onto said plane the portion C1 of the box in its opening stage, as shown in FIG. 10.

Figure 10:
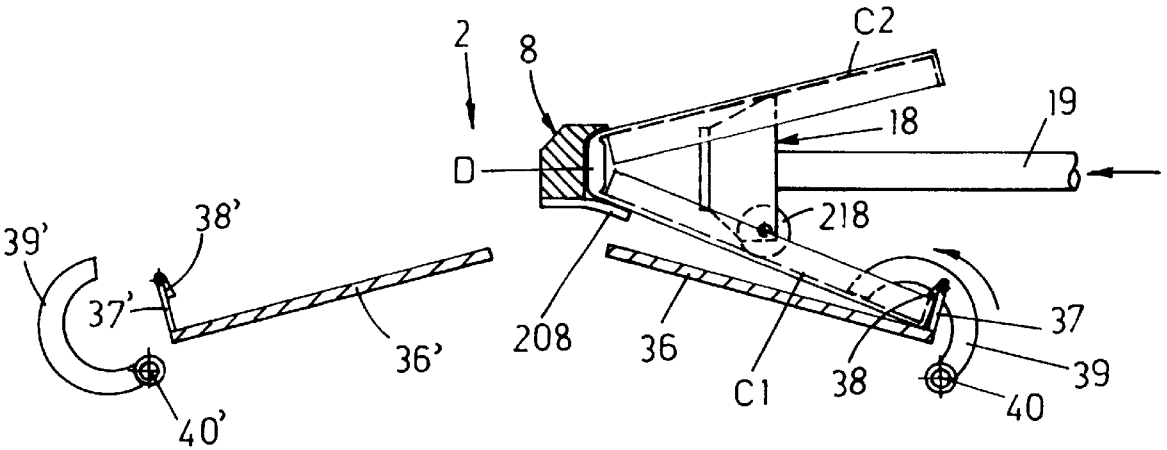
Figure 11:
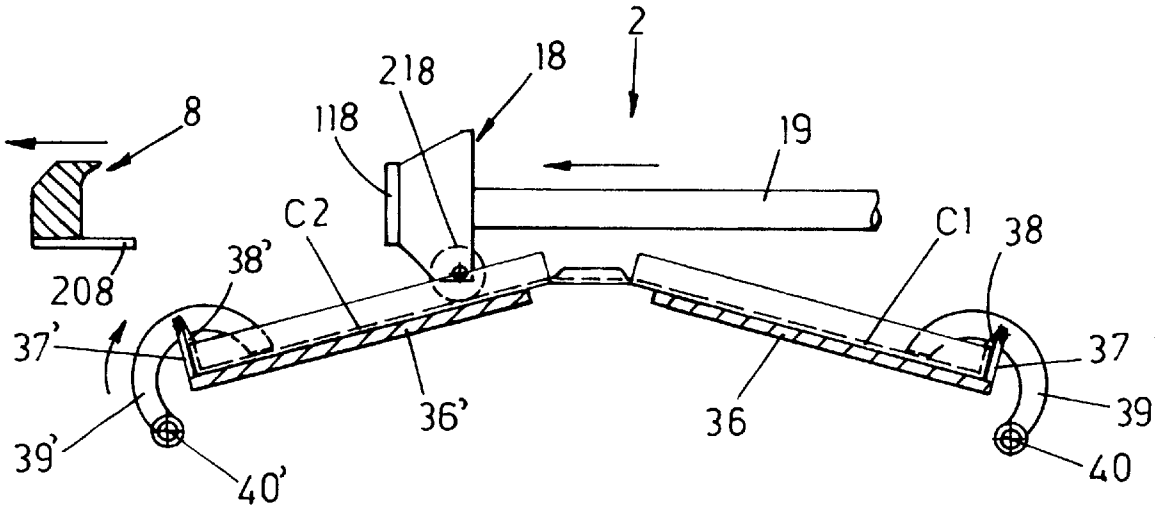

Subsequently the extractor 8 goes back to the magazine 1 together with the contrast means 18 which, as shown in FIG. 10 and 11, gets deeper and deeper into the box C, rotating the portion C2 away from portion C1 and placing it partially onto the second inclined plane 36' of the opening station 2, where said half-box C2 is definitely laid by one or more arc-shaped levers 39' fitted onto the shaft 40' operated by the group 41'-42' and where said half-box is locked by a resting edge 37' and by a springy tooth 38'.

Figure 12:
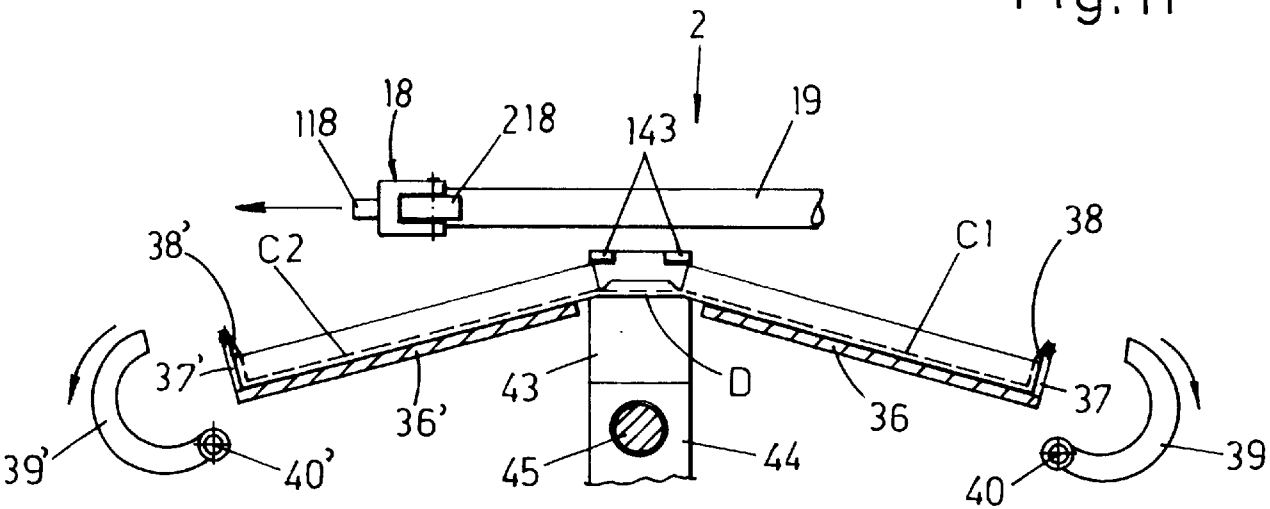
Figure 13:
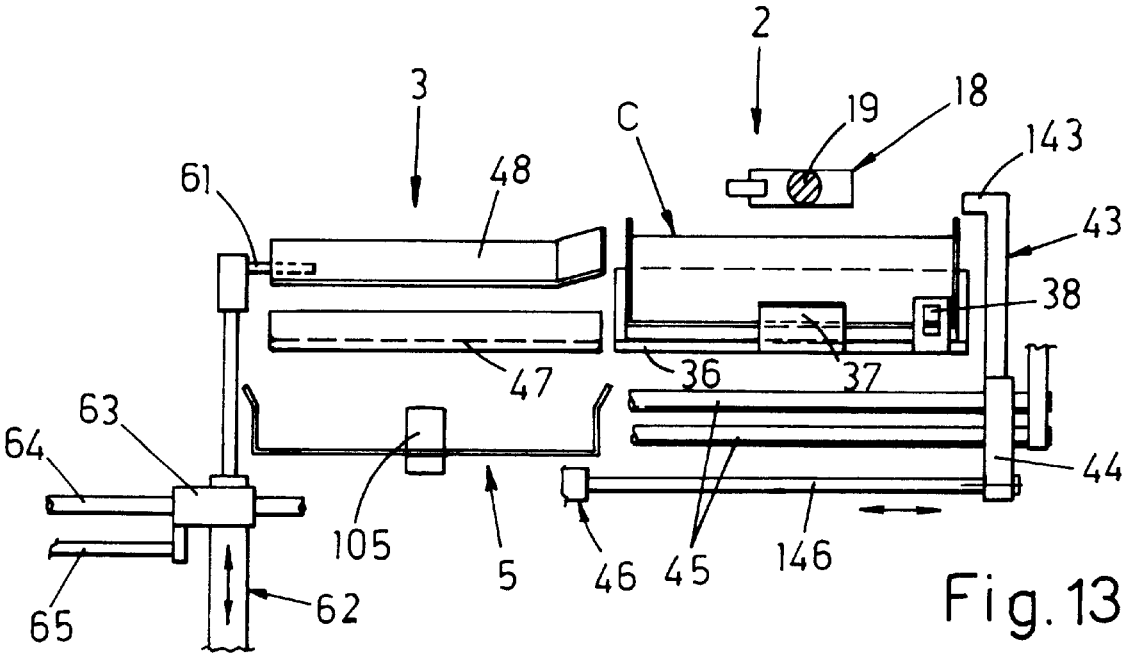
FIGS. 13 and 14 are front views of the box-opening station and of the adjacent parking station, seen in successive stages of their operating cycle.
Figure 14:
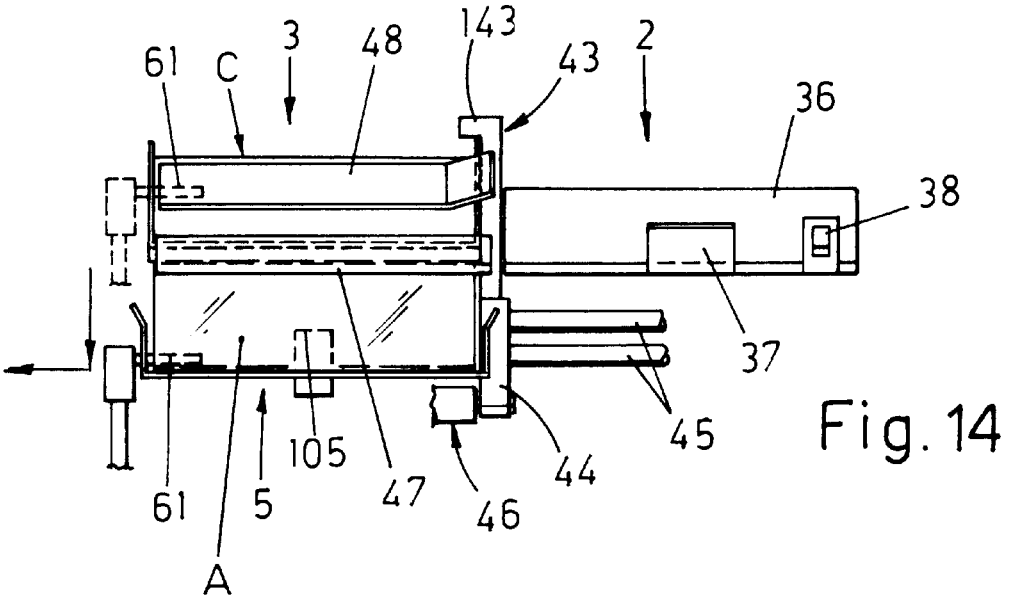

Successively, as shown in FIGS. 12 and 13, the contrast means 18, which has left the contact with the half-box C2 laid onto the plane 36', is rotated of 90° and brought back to the condition of cycle start so that its front protuberance 118 can be introduced into the recess R of the bottom box of the magazine 1. The arc-shaped levers 39, 39' are brought back to the rest position, so as to allow that the box opened in station 2 can be moved to the adjacent parking station 3 by a conveyor 43 integral with a carriage 44 sliding on guides 45 placed under the planes 36, 36' and which is connected to the stem 146 of a fluid pressure operating cylinder 46. The box C, being kept only by the springy teeth 38, 38', can freely slide on the planes 36, 36' and with respect to said teeth, and it remains with the portions C1 and C2 in the inclined double-slope position at least for the first part of the transfer stroke, which is necessary to move under control of the means in station 3. The conveyor 43, provided in its upper portion with protuberances 143 above the intermediate portion, higher than said box, also contributes to the withdrawal of the box during transfer with the correct sloped position of portions C1 and C2, thus preventing the lifting of the half-boxes C1 and C2 from the planes 36, 36'.

The planes 36, 36' of the opening station 2 and all the means associated to these, including the conveyor 43, are placed in a lower position than the path of a box in the stage of extraction from the magazine 1 by the extractor 8 and the contrast means 18, so that this extraction stage can be carried out simultaneously to the transfer stage of an open box from station 2 to adjacent station 3, thus increasing the productivity of the apparatus described.

From FIGS. 13 to 16 it appears that station 3 is equipped with a pair of guides 47, 47' with a "L"-shaped profile, lined up with the long and low sides of the planes 36, 36', on which the box rests and slides with the long and free sides of portions C1 and C2. Said station 3 comprises flat contrasts 48, 48' placed over portions C1 and C2 of the box to maintain them in the position shaped as an upside-down "V" and resting on said guides 47, 47'. The contrast means 48, 48' can be adjusted in their position and adapted to the box dimension by means of the jointed supports 148, the vertical guides 248 and the group adjustment screw-nut screw 348.

Figure 15:
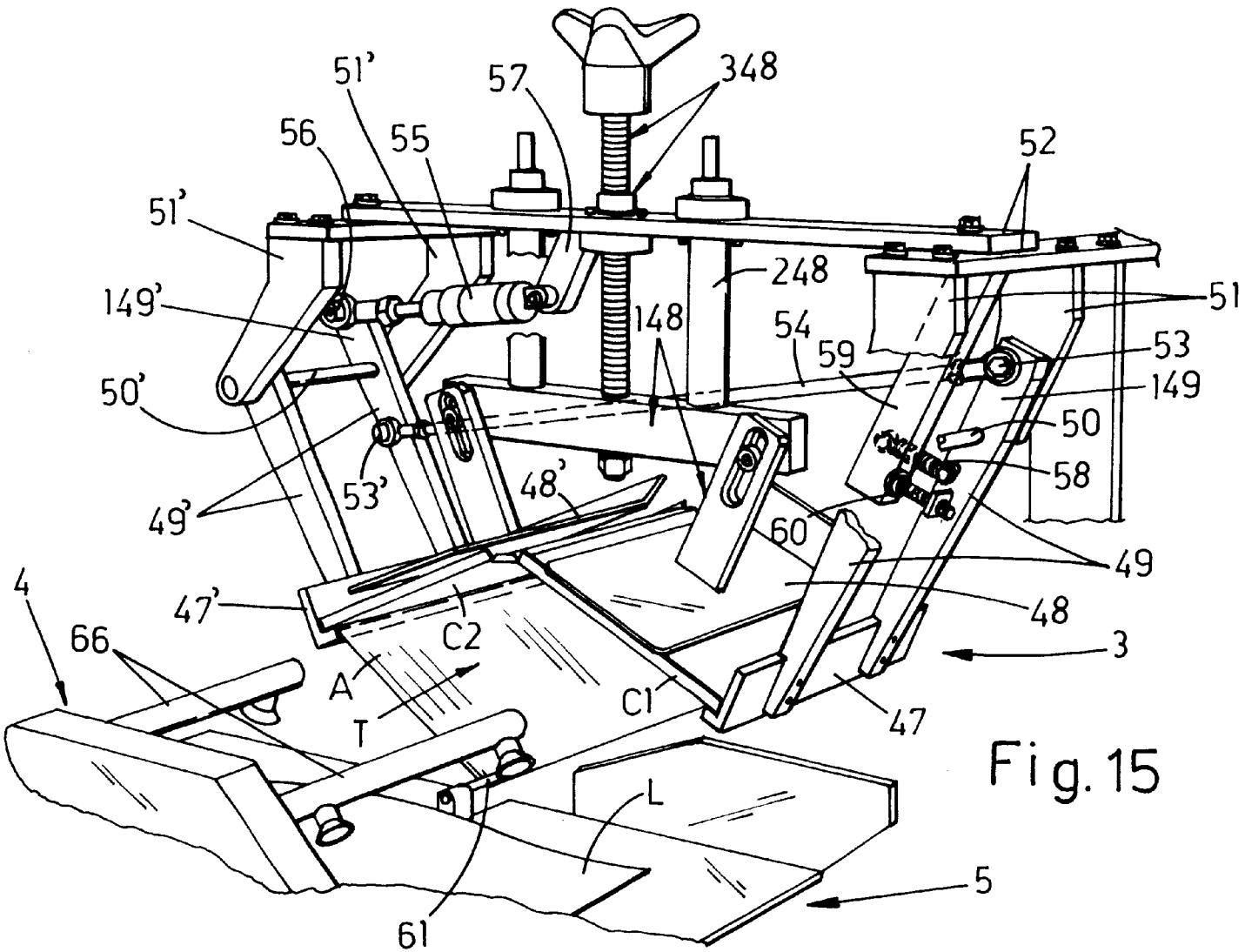
FIG. 15 shows a perspective lateral view of the parking station, in the stage shown in FIG. 14.

From FIG. 15 it appears that the guides 47, 47' are supported by pairs of levers 49, 49' turned upwards and pivoted in 50, 50' on supports 51, 51' integral with the fixed part 52 of the apparatus frame, each of said pairs of levers being equipped with an extension 149, 149' beyond the pivot 50, 50'. The extension 149 is connected in 53 to a tie-rod 54 which is connected in its turn in 53' to the opposite lever 49, under the pivot 50'. The distance between points 53 and 50 corresponds to the distance between the points 53', 50', so that the levers 49, 49' move with a self-centering movement of approach and removal, ensured by a fluid pressure cylinder 55 connected in 56 to the upper end of the extension 149' of the lever 49' and anchored with the other end to a fixed support 57. The cylinder 55 has for instance a simple effect and acts only in back motion. To one of the levers 49, under the pivot 50, is anchored a spring 58, which is anchored with its other end to a fixed support 59, in order to urge the levers 49, 49' in the rest position in which the guides 47, 47' are aligned with the planes 36, 36' of station 2, so as to receive from the latter the open box. An adjustable abutment is mounted onto the lever 49 with the spring 58 and usually rests against the back of the support 59.

Figure 16:
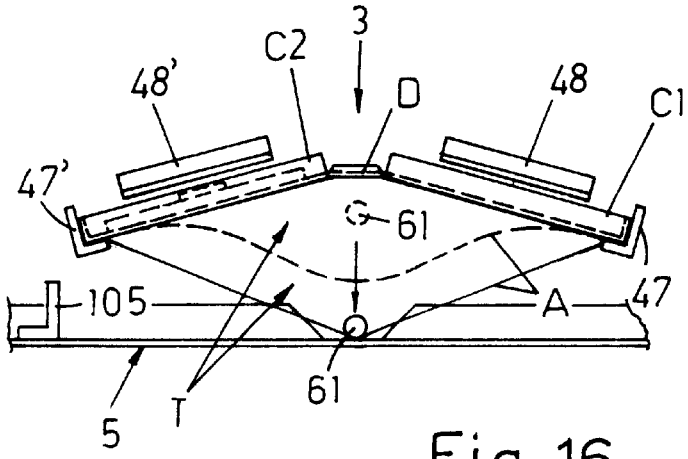
FIGS. 16, 17, 18 and 19 are further lateral views of the parking station seen in successive stages of its work cycle.

When the box is transferred from station 2 to station 3, the cover A in transparent plastic, which is no longer supported by any means, moves downwards by gravity, with a casual location, as indicated for instance by dash line in FIG. 16, partially opening the pocket T of the box. On the side of station 3 opposed to the one towards station 2 there is provided a lifted finger 61 placed in central position and brought by the stem of a vertical cylinder 62 mounted onto a carriage 63 moving on horizontal guides 64 under the action of a horizontal cylinder whose stem 65 is visible. The finger 61 is shaped so as to fit into the pocket T of the box transferred from station 2 to station 3, and, after the transfer has taken place, said finger 61 is lowered as in FIGS. 14 and 16, so as to stretch downwards the cover A and to open the pocket T until it has a lozenge-shaped section.

Figure 17:
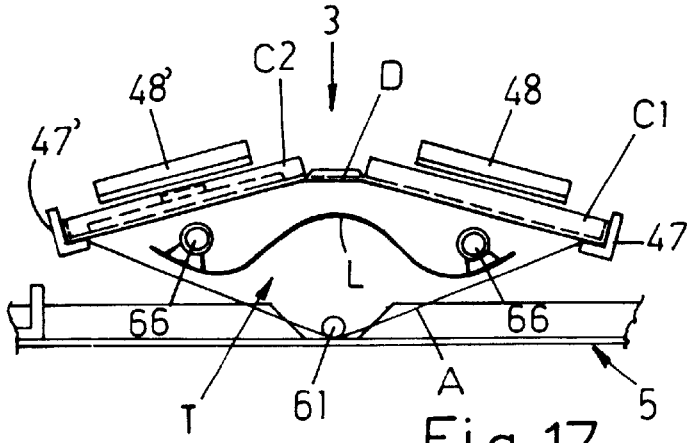
Figure 18:
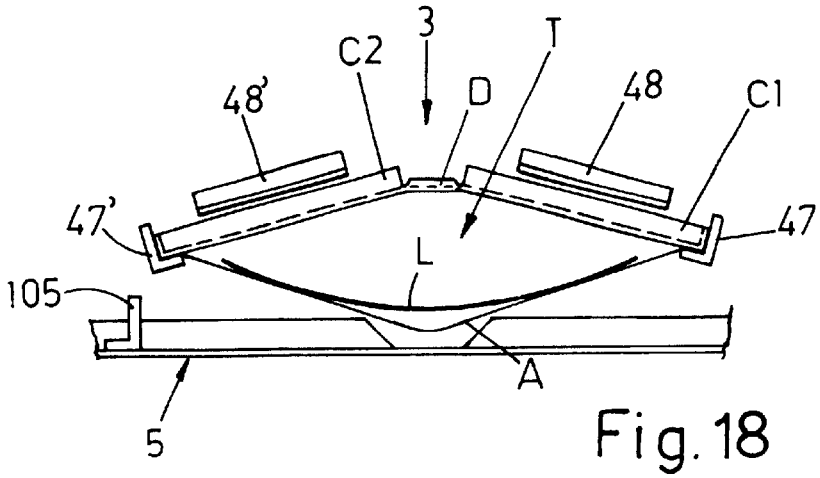
Figure 19:
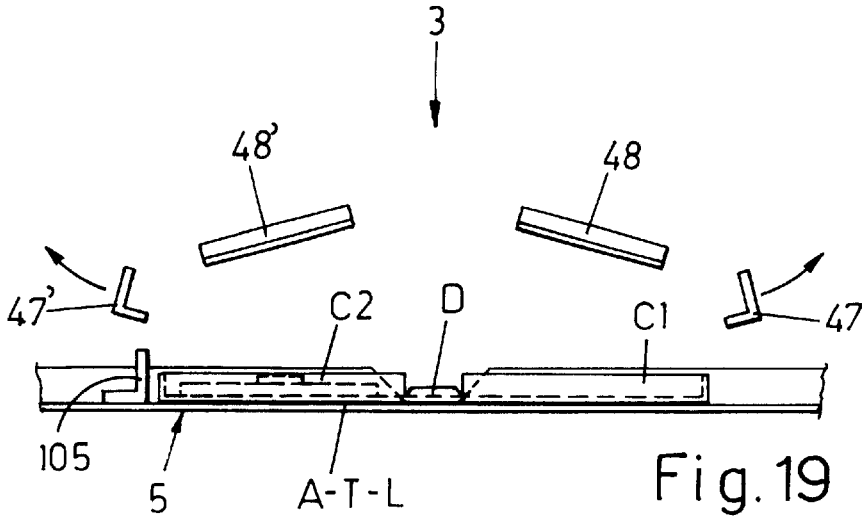

Successively, the arms provided with suction cups 66 (FIGS. 15 and 17) of a known station 4 (as described in Italian patent No. 1.249.227) take from the top of the pile a insert sheet L, bend it forming a Greek letter "omega" and in such a condition of reduced overall size and non-deformability they introduce it into the pocket T of the box, as can be seen in FIG. 17. The arms 66 are deactivated and go back to their rest positions, and also the finger 61 is extracted from the pocket as can be seen from FIG. 18, then the cylinder 55 of FIG. 15 is activated to bring away the guides 47, 47' one from the other and to enable the box to fall into the conveying channel 5, as can be seen from FIG. 19, then said guides go back to their rest position.

Figure 20:
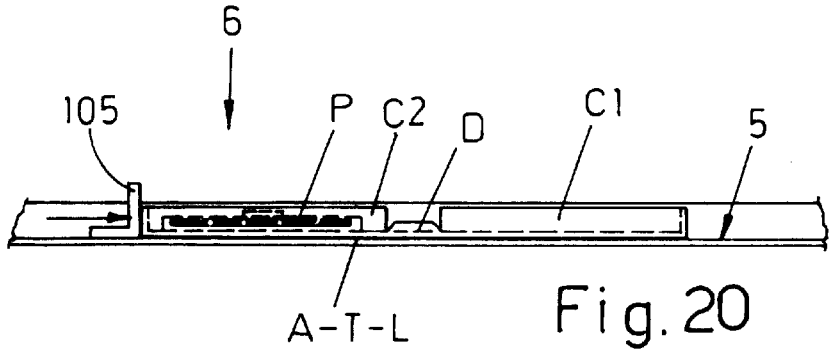
FIGS. 20 and 21 are lateral schematic views of the filling and box-closing stations.
Figure 21:
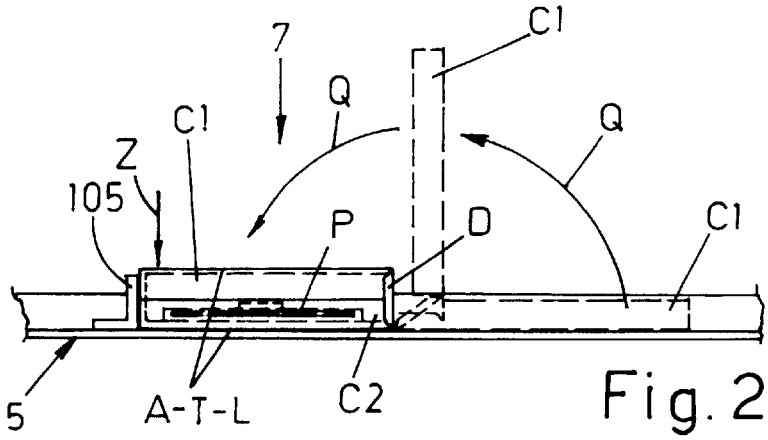

The conveying channel 5 is activated and transfers with one of its teeth 105 the open box into station 6, where known means introduce a disk P into the seat S, as can be seen from FIG. 20, then said box is transferred into station 7, where known means Q close said box by rotating and tipping portion C1 on portion C2 and by activating a pressing element Z which activates said snap-closing means E for said box. In one of stations 6 and/or 7 or in an intermediate station there can be provided for suitable means for the introduction of a leaflet into portion C1 of the box, under the tabs M. The customized box, filled and closed, is eventually unloaded from the conveyor 5, as indicated in FIG. 2 by arrow F5.

What is claimed is:

1. Apparatus for feeding DVD or CD boxes, empty and closed, to means for opening, customizing externally, filling and closing said boxes, comprising:

a magazine (1) in which the empty and closed boxes (C), consisting of two portions (C1, C2) interconnected like a book by means of a back (D), are placed horizontally and piled one onto the other with a pre-established orientation;

means (8, 18) to extract from said magazine (1) the bottom box and to transfer said box to an opening station (2);

means (14–17) to keep temporarily lifted from the bottom (201) of the magazine (1) all the boxes lying over the bottom one which is cyclically extracted, so as to enable the free return movement of the extraction means of said last box;

means (18–33, 36–42, 36'–42') to open the box in the opening station (2), placing the two portions (C1, C2) of said box with their inside upwards and resting externally on two underlying planes (36, 36') located so as to form a double slope, with the back (D) of the box placed between the high portions of said planes, means (38, 38') being provided to keep the box onto said resting planes, with the possibility to slide on said planes, parallel to the back;

means (43–46) to transfer the open box from the opening station (2) to an adjacent parking station (3) provided with parallel guides (47, 47') supporting the box on its long sides and equipped with contrast means (48, 48') to keep said box on said guides;

means (61) which are temporarily introduced into the central portion and on an end of the external pocket (T)

of the box transferred to the parking station, and which thereafter are lowered to stretch downwards the transparent cover (A) defining said pocket, so as to give a lozenge-shaped section to the latter;

means (66) which introduce into the open pocket of the box, within the parking station, a customizing insert sheet (L), which can be seen through the transparent cover (A) defining said pocket, and which then go back to their rest position together with said opening means (61) for said pocket;

means (49–60) to move apart said guides (47, 47') supporting the box in the parking station, to allow said box to fall open and horizontally into underlying conveying means (5) which will then transfer it into following filling (6) and closing (7) stations.

2. Apparatus according to claim 1, in which the magazine containing the pile of empty and closed boxes (C) is provided with a bottom wall (201) contacting said pile only in the central area to enable the lateral transfer of lower tabs (208) with which said extraction bar or extractor (8) is provided, the latter sliding over said bottom wall to extract the lower box of said pile, said extractor (8) being connected with one end and in a protruding position to a carriage (308) with corresponding guiding means (9) and means for rectilinear and alternated movement (13), said extractor being slightly lower than the thickness of a box so as not to graze upon the second-last bottom box of the pile, the extractor front being equipped with a hollow profile (108) which forms with said tabs (208), preferably flexible, a seat containing and jointing the back (D) of the boxes cyclically extracted from the magazine (1), said boxes being orientated with their back towards the extractor in its position of cycle start, upstream from the box pile placed in said magazine (1).

3. Apparatus according to claim 2, in which on the lateral walls of the magazine (1) there are provided extensions (17, 115) which are all or partly mounted on respective oscillating levers (15) provided with a roller (14), which cooperates thanks to elastic means with the extractor (8) deactivating said extensions when it is in its position of cycle start upstream from the pile of magazined boxes and activating said extensions when it leaves the magazine to extract the bottom box, so that said extensions act onto the sides of the second-last bottom box of the pile to keep it lifted, said condition being maintained until the extractor goes back to its position of cycle start.

4. Apparatus according to claim 2, in which the central recess (R) of the bottom box of the magazine (1), opposite the back (D) of said box on the side of the extractor (8), is engaged by the front protuberance (118) of a contrast means (18), for instance substantially trapezoidal, integral with the larger base of a stem (19) lined up with the stroke of said extractor, and which is rotatably carried by the protruding end of the lower portion (120) of a "L"-shaped lever (20) which is fulcrumed with said lower portion, orthogonal to said stem, to a carriage (21) sliding with friction on corresponding guides (31), horizontal and parallel to the guides of the carriage of the extractor (8), means being provided (35, 135) to approach the contrast means (18) to the box to be extracted from the feeding magazine (1), said means being then deactivated so that the contrast means remains in contact with the box pushed and supported by the extractor and supports the latter while its carriage (21) slides with friction on corresponding guides, the lever (20) carrying the contrast means (18) being urged by a spring (24) against an adjustable abutment (26) carried by the carriage (21), so that the stem (19) of the contrast means remains in horizontal position or, if necessary, it can oscillate upwards in contrast with said spring, said stem of the contrast means being equipped on its end and in squaring position with a lever arm (27) connected to the stem of an operating cylinder (29), which is anchored in its turn with the body onto the top of the vertical portion (220) of said oscillating lever (20), said cylinder being structured so as to bring upon actuation the contrast means (18) from the horizontal position corresponding to the box pick-up to the vertical or lateral position for opening said box.

5. Apparatus according to claim 4, in which the contrast means (18) is equipped with an idle roller (218) on its side, which is orientated downwards in the opening stage of the box, so that said contrast means slides on said box with a rolling friction.

6. Apparatus according to claim 4, in which elastic means (33) are provided which are loaded when the carriage (21) of the contrast means (18) reaches the stroke end of the extraction of said box and of the transfer of said box into the opening station (2), so that when the contrast means is rotated of 90° and placed laterally to open the box, said elastic means extend and immediately push the contrast means between the portions (C1, C2) of the open box.

7. Apparatus according to claim 6, in which the station (2) for opening the boxes comprises two fixed planes (36, 36') placed as a double slope under the box during its opening by the contrast means (18), so as to support both portions (C1, C2) of the open box, which is located with its back (D) between the high sides, removed one from the other, of said planes, the latter being equipped on their long and low side with edges (37, 37') to keep the box open, and being equipped with oscillating springy teeth (38, 38') under which are introduced snap-wise the free and long sides of both half-boxes (C1, C2), which stay therefore open and can be transferred into the adjacent parking station (3).

8. Apparatus according to claim 7, in which in the opening station (2) it is provided for arc-shaped levers (39, 39') operated by respective actuators (42, 42'), acting in due time together with the contrast means (18) to open the box and to bring the two portions (C1, C2) it consists of onto the inclined planes (36, 36') of said opening station, being provided that said arc-shaped levers are deactivated when the box is transferred from the opening station (2) into the adjacent parking station (3).

9. Apparatus according to claim 8, in which under the opening station (2) there are provided guides (45) and means (46) for handling a carriage (44) carrying a conveyor (43) orientated upwards, generally placed on a side of said station and passing upon actuation between the inclined planes (36, 36') to transfer the open box into the adjacent parking station (3).

10. Apparatus according to claim 9, in which the conveyor (43) is provided in its upper portion with protuberances (143) placed over the back area of the box during its transfer towards the parking station (3), so as to keep said box in its position as an upside-down "V".

11. Apparatus according to claim 9, in which the inclined planes (36, 36') of the opening station and the conveyor (43) are placed in a lower position than the path of a box in the stage of extraction from the feeding magazine (1), and of transfer onto said opening station, so that said extraction stage can be carried out also during the transfer stage of an open box from the opening station (2) to the adjacent parking station (3).

12. Apparatus according to claim 1, in which the guides (47, 47') of the parking station (3) are supported by oscillating levers (49, 49') interconnected one to the other by means of a tie-rod (54) for a self-centering movement, and connected to a moving cylinder (55) operating them while opening, and connected to a spring (58) recalling them to their rest position where said levers are kept by the resting of their adjustable abutment (60) against a fixed support (59).

13. Apparatus according to claim 12, in which the contrast planes (48, 48') are supported by a jointed structure (148), by vertical guiding means (248) and by a screw-nut screw register (348) allowing to adapt said contrast planes to boxes having different dimensions.

14. Apparatus according to claim 1, in which on the side of the parking station (3) opposite the one towards the opening station (2), there is provided, aligned with the central line of said parking station, a horizontal finger (61) which is introduced into said pocket (T) of said box transferred into said parking station and which is mounted onto a lifting and lowering actuator (62), which upon actuation lowers said finger for opening said pocket, said actuator being mounted onto a carriage (63) which slides thanks to its own actuator (65) on horizontal guides (64), first to approach said finger to said pocket and then to remove it from said pocket, respectively in said opening stage and after the stage of introduction into said pocket of the customizing insert sheet (L).

15. Apparatus according to claim 1, in which on the side of the parking station (3) where acts the opening finger (61) for the external pocket (T) of the box located in said station, a known station (4) is located, which cyclically picks up with its moving suction arms (66) a insert sheet (L) from a feeding pile, arranges said insert sheet with an undulated profile, introduces it into said pocket (T) and then goes back to its rest position.

* * * * *